US011653740B2

(12) United States Patent
Tanaka

(10) Patent No.: US 11,653,740 B2
(45) Date of Patent: May 23, 2023

(54) COSMETIC CONTAINER

(71) Applicant: SINWA CORPORATION, Kanagawa (JP)

(72) Inventor: Akihiro Tanaka, Kanagawa (JP)

(73) Assignee: SINWA CORPORATION, Kanagawa (JP)

( * ) Notice: Subject to any disclaimer, the term of this patent is extended or adjusted under 35 U.S.C. 154(b) by 0 days.

(21) Appl. No.: 17/610,624

(22) PCT Filed: May 14, 2019

(86) PCT No.: PCT/JP2019/019126
§ 371 (c)(1),
(2) Date: Nov. 11, 2021

(87) PCT Pub. No.: WO2020/230266
PCT Pub. Date: Nov. 19, 2020

(65) Prior Publication Data

US 2022/0322810 A1 Oct. 13, 2022

(51) Int. Cl.
*A45D 34/04* (2006.01)
*A45D 40/26* (2006.01)

(52) U.S. Cl.
CPC ..... *A45D 34/046* (2013.01); *A45D 40/267* (2013.01)

(58) Field of Classification Search
CPC .. A45D 34/042; A45D 34/043; A45D 34/045; A45D 34/046; A45D 34/047; A45D 40/262; A45D 40/264; A45D 40/265; A45D 40/267; A45D 40/268
USPC ..... 401/121, 122, 126–130
See application file for complete search history.

(56) References Cited

U.S. PATENT DOCUMENTS 5,597,254 A 1/1997 Vasas
6,390,708 B1 5/2002 Gueret
8,721,210 B2 * 5/2014 Wilczynski ..... B29C 45/1676 401/121

(Continued)

FOREIGN PATENT DOCUMENTS

JP 11990040318 U 3/1990
JP 08-228829 A 9/1996

OTHER PUBLICATIONS

International Search Report issued in the corresponding PCT Application No. PCT/JP2019/019126 dated Aug. 6, 2019.

*Primary Examiner* — David J Walczak
(74) *Attorney, Agent, or Firm* — Thomas W. Cole; Calderon Safran & Cole P.C.

(57) ABSTRACT

A cosmetic container including a wiper capable of avoiding a pumping phenomenon without deterioration in scraping effect is provided. A wiper fitted to an opening of a cosmetic container includes a plurality of tongue pieces having the same shape disposed evenly in a circumferential direction and extending downward inside the container. Regions of the tongue pieces adjacent to each other partially overlap in the circumferential direction and are joined integrally at the overlapping portion. A length of the tongue pieces in an axial direction gradually decreases from one circumferential side edge portion toward the other side edge portion. In the overlapping portion, a tongue piece side short in the axial direction is disposed inside so as to form a groove between the tongue pieces, extending in the circumferential direction, that allows for air to pass between outside and inside spaces of the wiper.

9 Claims, 11 Drawing Sheets

(56) References Cited

U.S. PATENT DOCUMENTS

| | | | | |
|---|---|---|---|---|
| 10,448,725 | B2 * | 10/2019 | Weigel | A45D 34/046 |
| 10,667,594 | B2 * | 6/2020 | Aso | A45D 34/046 |
| 2004/0168701 | A1 | 9/2004 | Hiyama | |
| 2012/0204899 | A1 | 8/2012 | Uehara et al. | |
| 2014/0369736 | A1 | 12/2014 | von Jan | |

* cited by examiner

COSMETIC CONTAINER

CROSS-REFERENCE TO RELATED APPLICATIONS

The present application is a U.S. National Phase of PCT/JP2019/019126 filed on May 14, 2019. The disclosure of the PCT Application is hereby incorporated by reference into the present Application.

TECHNICAL FIELD

The present invention relates to a cosmetic container, specifically, to a liquid cosmetic container having a wiper circumferentially provided inside of an insertion opening for a cosmetic applicator.

BACKGROUND ART

Conventionally, as a liquid cosmetic container, there is a type composed of a container main body containing a cosmetic and an applicator that also serves as a cap that can be fitted to an opening of the container main body. On an inner circumference of the opening of the container main body, a wiper made of a flexible member such as resin or rubber is circumferentially provided so that, when the applicator is pulled out from the container main body, excess cosmetic adhering to a stem portion of the applicator is scraped off by the wiper.

The wiper has a configuration in which an inner diameter at a tip end portion serving as a scraping portion of the wiper is formed to be smaller than an outer diameter of the stem portion so that a cosmetic adhering to the stem portion can be reliably scraped off, and the scraping portion of the wiper comes into close contact with the stem portion. Therefore, when the applicator is inserted into the container main body, the pressure inside the container main body increases and creates a problem of a so-called pumping phenomenon in which cosmetic inside the container main body is pushed out and the applicator is pushed back. In addition, when pulling out the applicator fitted to the container main body, the pressure inside the container main body becomes negative and acts as resistance to obstruct pulling-out of the applicator, and creates another problem in which it is difficult to smoothly pull out the applicator.

In order to solve this, for example, in Patent Literature 1, a circumferential partial region including the scraping portion of the wiper is offset in the axial direction, and scraping portions in a junction portion between an offset region and a non-offset region of the wiper overlap in the axial direction, and a groove extending circumferentially on an inner circumferential surface of the scraping portion overlap region is formed.

CITATION LIST

Patent Literature

[Patent Literature 1] Japanese Published Unexamined Patent Application No. 2003-24135

SUMMARY OF INVENTION

Technical Problem

However, in the wiper of Patent Literature 1, an offset region offset in which the tip end portion is displaced in the axial direction and a non-offset region in the tip end portion, that is, two regions with different masses are formed in a circumferential direction of the one wiper, so that the overall mass balance is poor, and even when the wiper is press-fitted in the opening of the container main body, it is fixed in a tilting state, and the wiper easily tilts when the applicator is pulled out and inserted, and this creates a problem in which cosmetic scraping becomes uneven.

In view of this problem, an object of the present invention is to provide a cosmetic container with a wiper capable of avoiding a pumping phenomenon without deterioration in scraping effect.

Solution to Problem

In order to achieve the object described above, a cosmetic container in an aspect according to a configuration of the present disclosure includes a container main body configured to hold a cosmetic, and an applicator to be detachably attached to an opening of the container main body, where a flexible wiper configured to scrape the cosmetic adhering to the applicator is press-fitted to the inside of the opening of the container main body, wherein the wiper includes a cylindrical portion to be fitted to the inside of the opening, and a plurality of tongue pieces having the same shape disposed evenly in a circumferential direction and extending downward inside the container main body from the cylindrical portion, the plurality of tongue pieces are disposed so that regions of the tongue pieces adjacent to each other partially overlap in the circumferential direction and are joined and integrated in the overlapping portion, each of the tongue pieces is formed so that an extending length of a first circumferential side edge portion on one side in an axial direction becomes longer by a predetermined length than an extending length of a second circumferential side edge portion on the other side in an axial direction, and in each of the portions where the tongue pieces adjacent to each other overlap, the tongue pieces are disposed so that the tongue piece with the short extending length in the axial direction is inside, and inside the overlap region, a groove sandwiched between the tongue pieces, extending in the circumferential direction, and allowing for communication between outside and inside spaces of the wiper, is formed.

According to this aspect, a groove serving as an air passing hole is formed in the overlap region of the tongue pieces, and allows for communication between the inside and the outside of the wiper, that is, between the inside and the outside of the container main body even when the applicator is pulled out from or inserted in the container main body, so that air enters and exits through this groove, and a pumping phenomenon can be prevented. In addition, a plurality of tongue pieces are disposed evenly in the circumferential direction, and a plurality of grooves are also provided evenly in the circumferential direction, so that the overall mass balance is good, and even when the wiper is press-fitted in the opening of the container main body, the wiper is prevented from being fixed in a tilting state, and prevented from tilting when the applicator is pulled out or inserted, and therefore, cosmetic scraping is unlikely to become uneven.

In an aspect, it is configured that a boundary portion as a level difference extending in an axial direction is formed at substantially the center of the tongue piece, and the boundary portion divides the tongue piece into two regions of a first region including the first circumferential side edge portion having a long extending length in the axial direction and a second region including the second circumferential side edge portion having a short extending length in the axial direction, and in the first region, from the first circumferential side edge portion at which the extending length in the axial direction is longest toward the boundary portion, the extending length in the axial direction gradually decreases, and in the second region, it is configured that the extending length in the axial direction is longest at the boundary portion, and the extending length in the axial direction gradually decreases from the boundary portion toward the second circumferential side edge portion.

According to this aspect, regions the number of which is twice as many as the number of tongue pieces having substantially the same shape exist in the circumferential direction, so that the overall mass balance is further improved. Further, the boundary portion forms a thick portion extending in the axial direction, so that the tongue piece is improved in rigidity. Accordingly, deterioration in scraping effect caused by deterioration in rigidity of the tongue pieces according to pulling-out and insertion of the applicator can be prevented.

In an aspect, in a portion where the second circumferential side edge portion of the tongue piece overlaps the adjacent tongue piece, a cutout is formed.

According to this aspect, the cutout increases the sectional area of the groove, and accordingly, air easily passes through, so that the applicator can be smoothly pulled out and inserted.

In an aspect, a level difference portion is formed inside of the tongue piece so that the first circumferential side edge portion side becomes thin.

According to this aspect, the sectional area of the groove can be increased as much as the level difference, and accordingly, air easily passes through, so that the applicator can be smoothly pulled out and inserted.

Effect of Invention

A cosmetic container with a wiper capable of avoiding a pumping phenomenon without deterioration in scraping effect can be provided.

DESCRIPTION OF EMBODIMENTS

Hereinafter, preferred embodiments of the present invention will be described with reference to the drawings. The embodiments are not intended to limit the invention but is an illustration, and all features described in the embodiments and combinations thereof are not always essential for the present invention.

(Cosmetic Container)

Figure 1:
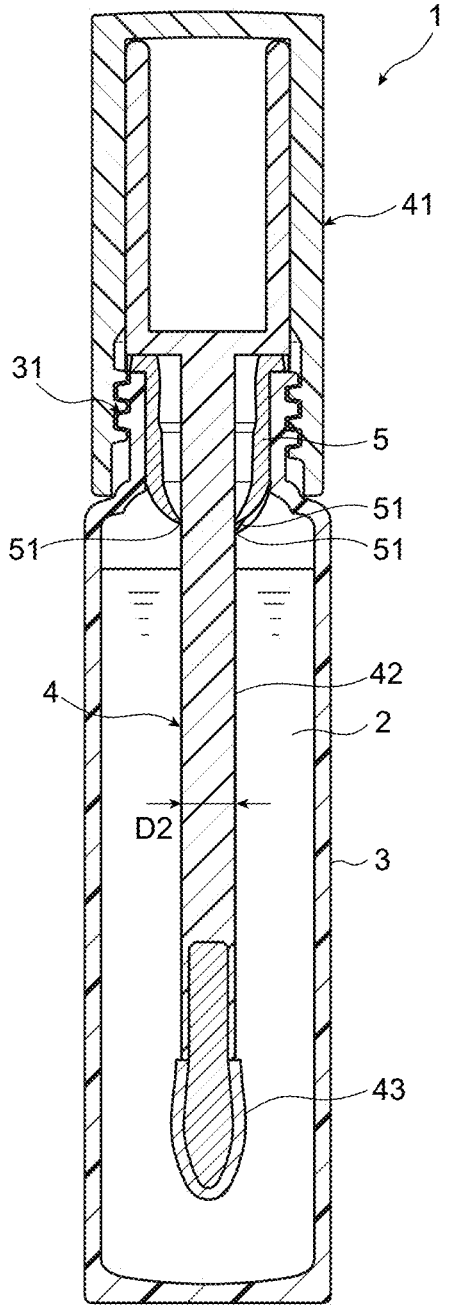
FIG. 1 is a longitudinal sectional view of a cosmetic container according to an embodiment of the present invention.

FIG. 1 is a longitudinal sectional front view of a cosmetic container 1 according to an embodiment of the present invention. The cosmetic container 1 includes a container main body 3 containing cosmetic 2, and an applicator 4 that can be fitted to the container main body 3.

The container main body 3 is a thin and long cosmetic container containing cosmetic 2 inside. At an upper end portion of the container main body 3, an opening 31 that decreases in diameter and opens at an upper face is formed.

As the cosmetic 2, liquid cosmetic that has fluidity in a usage environment, such as lip gloss, liquid rouge, or mascara, is used.

The applicator 4 is composed of a cap 41, a stem portion 42 extending from the cap 41 to the container main body 3, and an applying portion 43 provided at a tip end of the stem portion 42. The stem portion 42 has an upper end portion increased in diameter and fixed integrally to the cap 41. Onto a surface of the applying portion 43, flocky treatment (treatment method for finishing into a velvety appearance by attaching cotton, synthetic fabric, etc., that is cut to have a length of several mm) is applied. For the applying portion 43, according to the purpose of use and cosmetic 2, a brush, a silicon brush, a brush, etc., formed of a large number of bristles may be used.

On an outer circumference of the opening 31, a male thread is formed with which a female thread portion formed on an inner circumference of a lower portion of the cap 41 is screwed together. In a state where the cap 41 is screwed to the container main body 3, the applying portion 43 is positioned slightly higher than the bottom portion of the container main body 3. To the inside of the opening 31 through which the applicator 4 is pulled out or inserted, a wiper 5 is press-fitted and fixed.

(Wiper)

Figure 2:
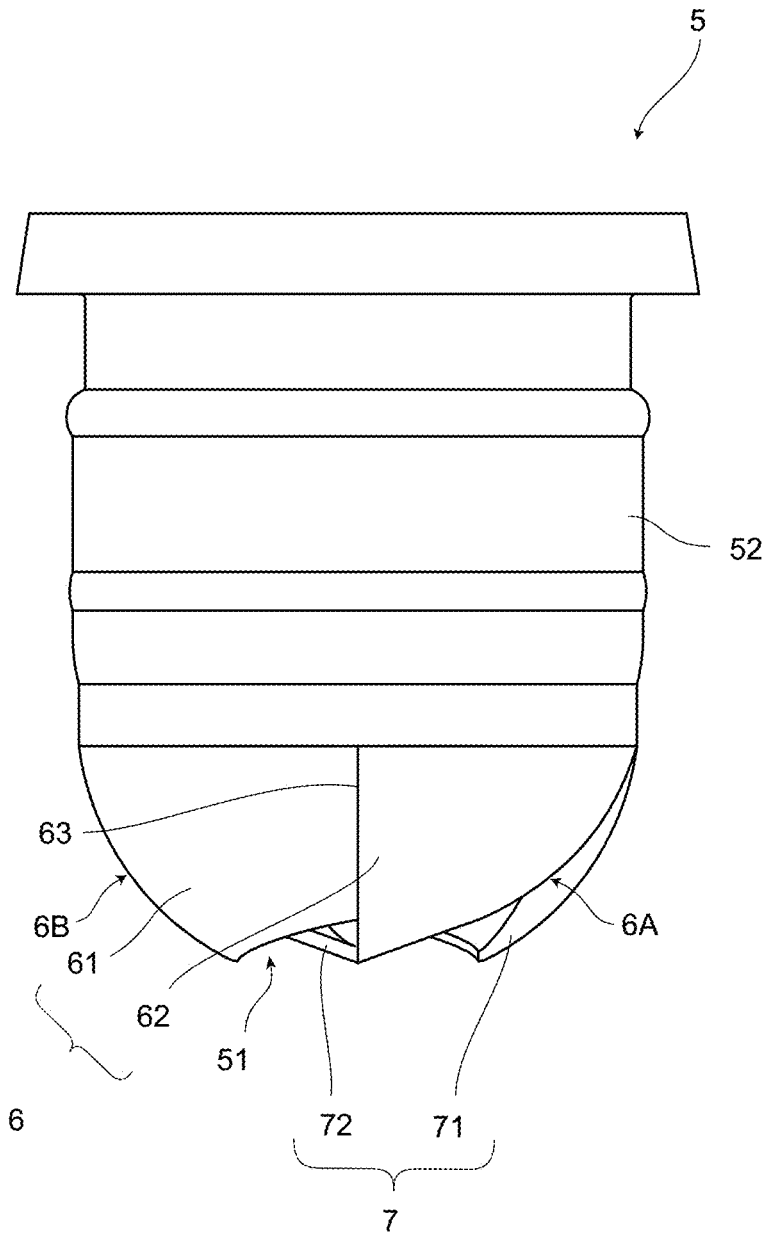
FIG. 2 is a front view of a wiper as an essential portion of the cosmetic container.
Figure 3:
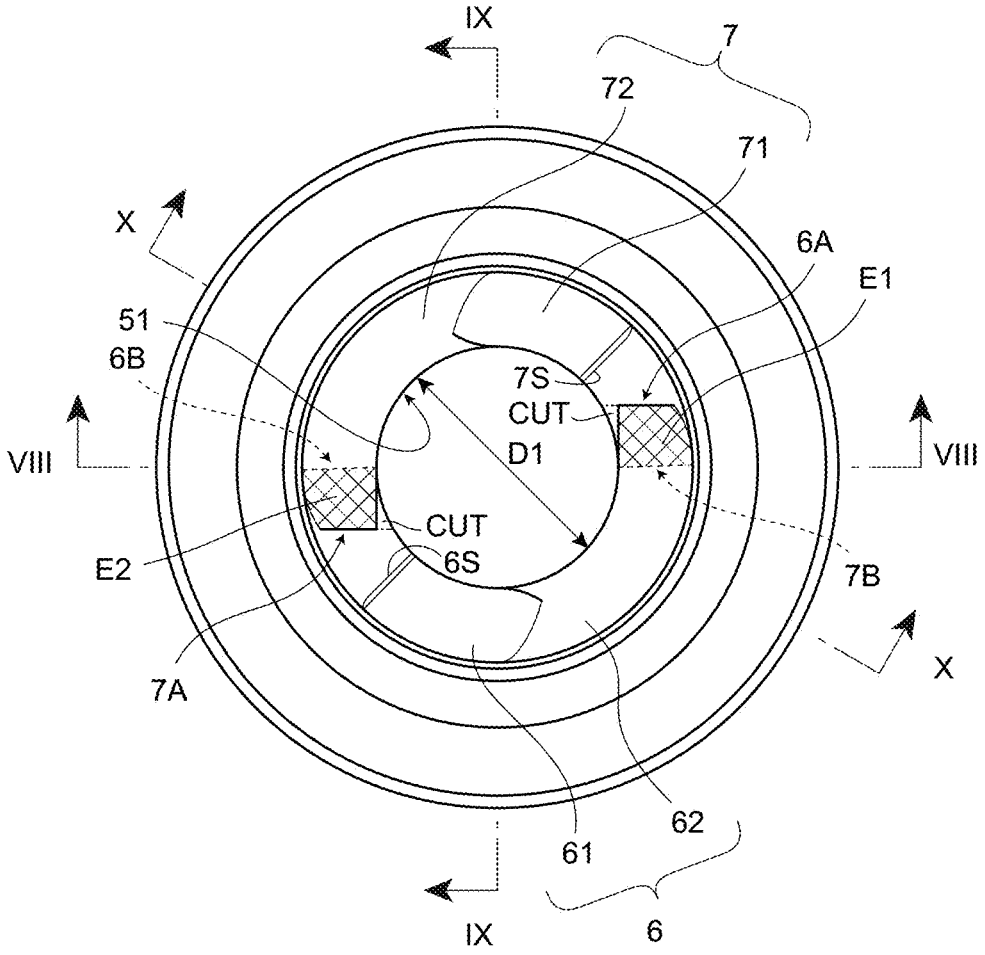
FIG. 3 is a plan view of the wiper.
Figure 4:
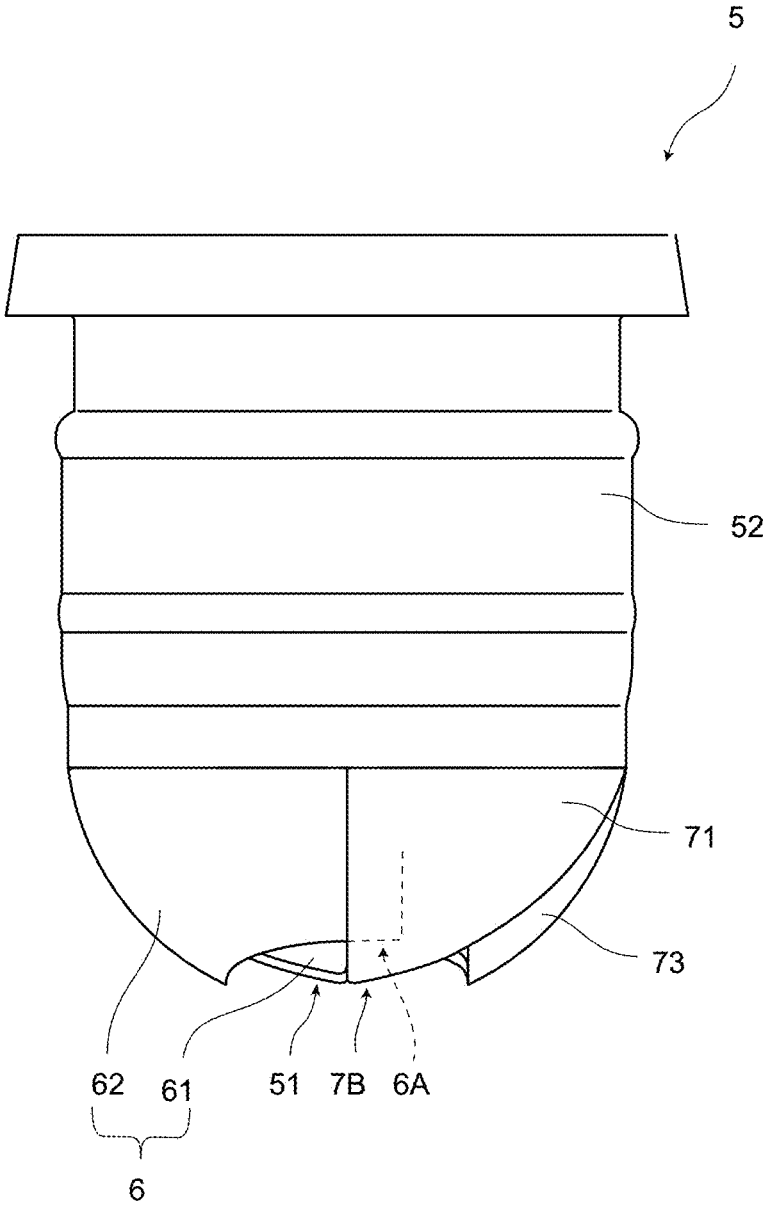
FIG. 4 is a right side view of the wiper.
Figure 5:
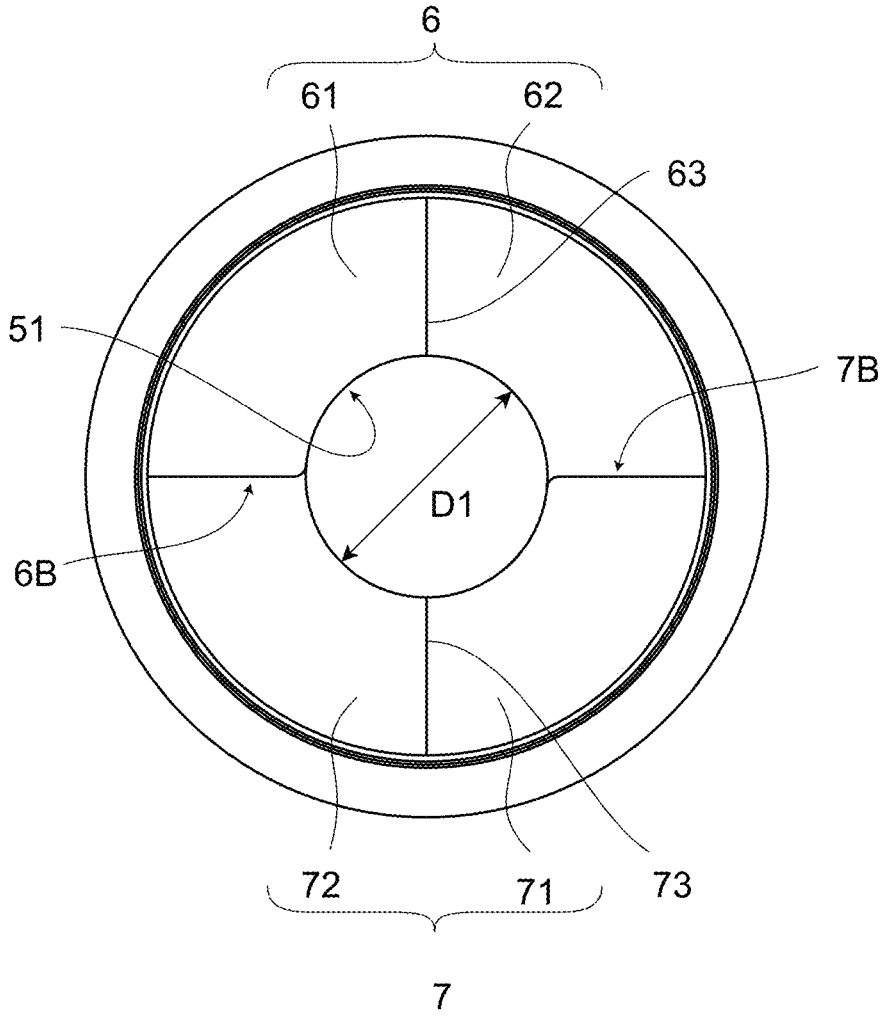
FIG. 5 is a bottom view of the wiper.

The wiper 5 that is an essential portion of the present invention will be described in detail with reference to FIGS. 2 to 11. FIGS. 2 to 5 are six-side views of the wiper 5, and FIG. 2 is a front view, FIG. 3 is a plan view, FIG. 4 is a right side view, and FIG. 5 is a bottom view. The wiper 5 is point-symmetric, and the back view is the same as the front view, and the right side view is the same as the left side view, so that these are omitted.

Figure 6:
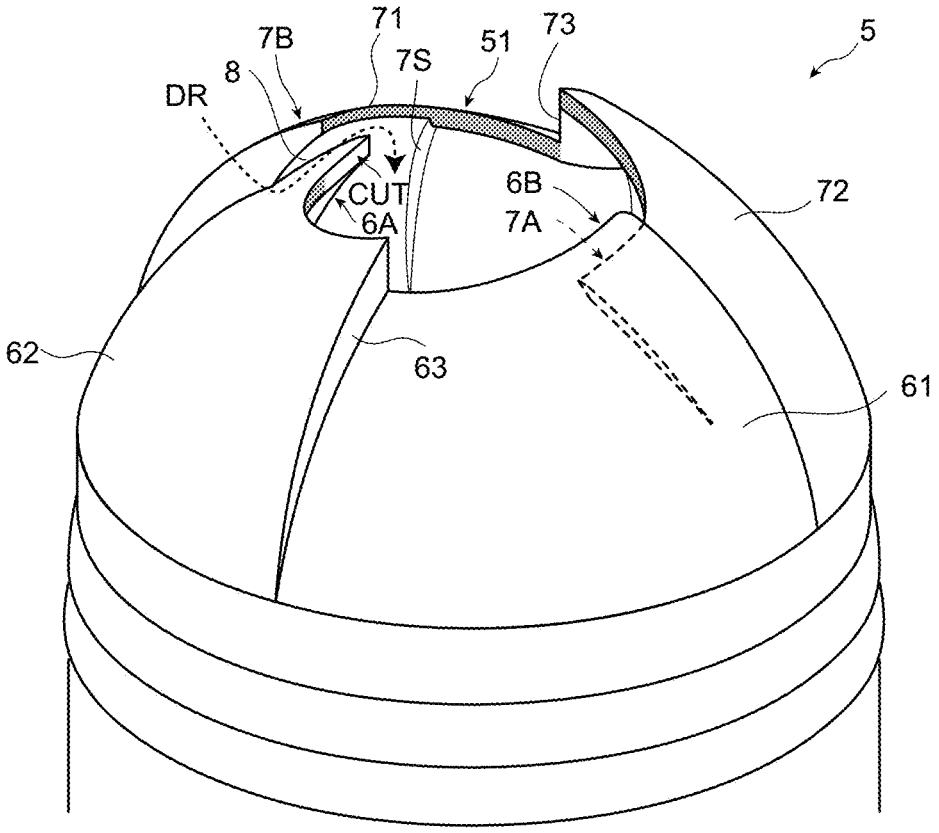
FIG. 6 is an enlarged perspective view of the wiper, arranged upside down for easy viewing of a tip end portion of the wiper.
Figure 7:
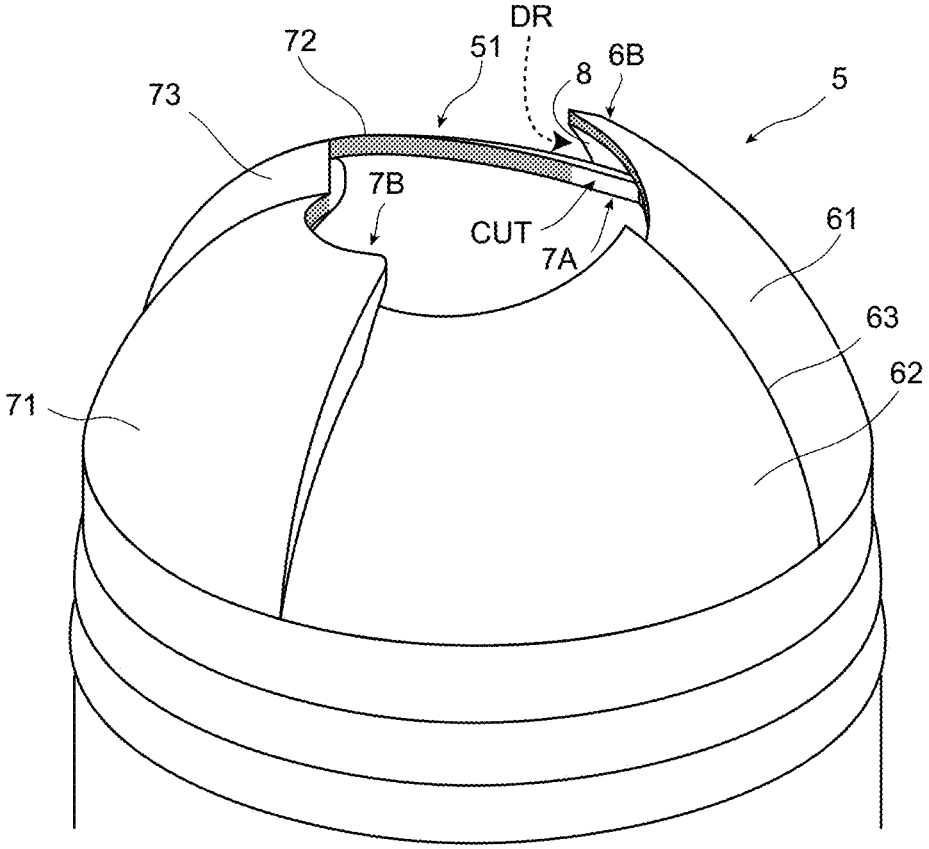
FIG. 7 is an enlarged perspective view of the wiper, illustrating a state rotated by 90 degrees from the state in FIG. 6.

FIGS. 6 and 7 are enlarged perspective views of the wiper 5, arranged upside down so that the tip end portion (bottom portion side) of the wiper 5 is easily viewed. FIG. 6 is a perspective front view, and FIG. 7 illustrates a state rotated 90 degrees around the central axis Y of the wiper 5 as a rotation axis from the state shown in FIG. 6.

Figure 8:
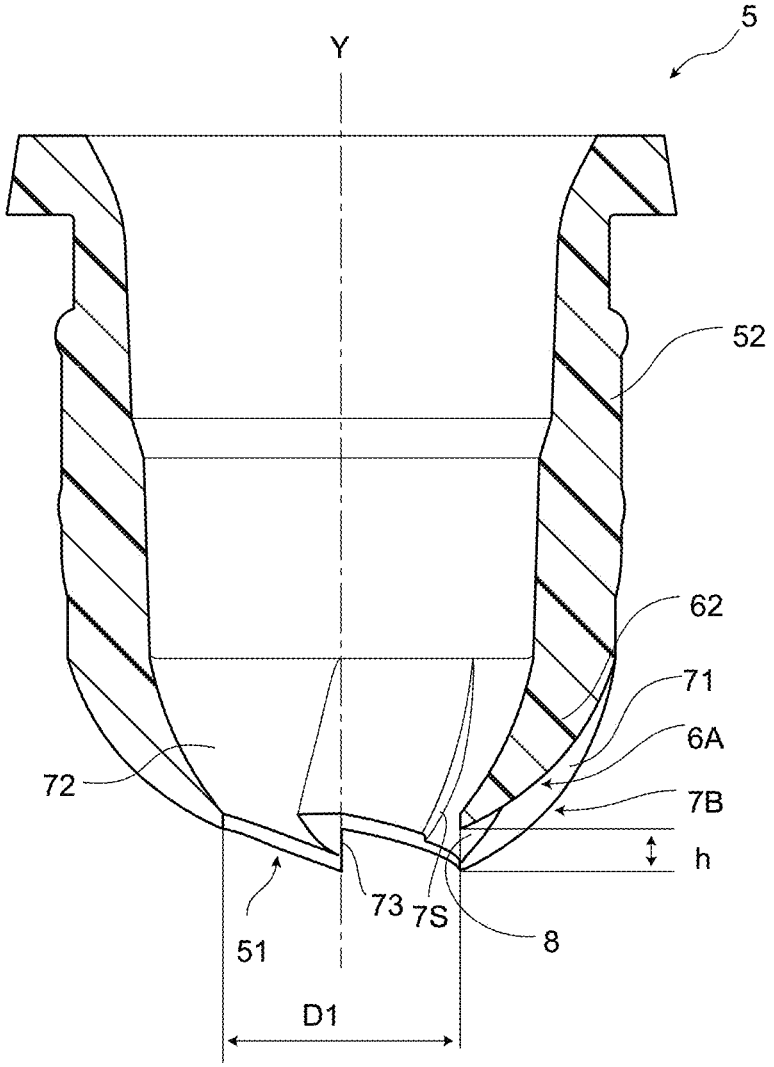
FIG. 8 is a sectional view taken along line VIII-VIII in FIG. 3.
Figure 9:
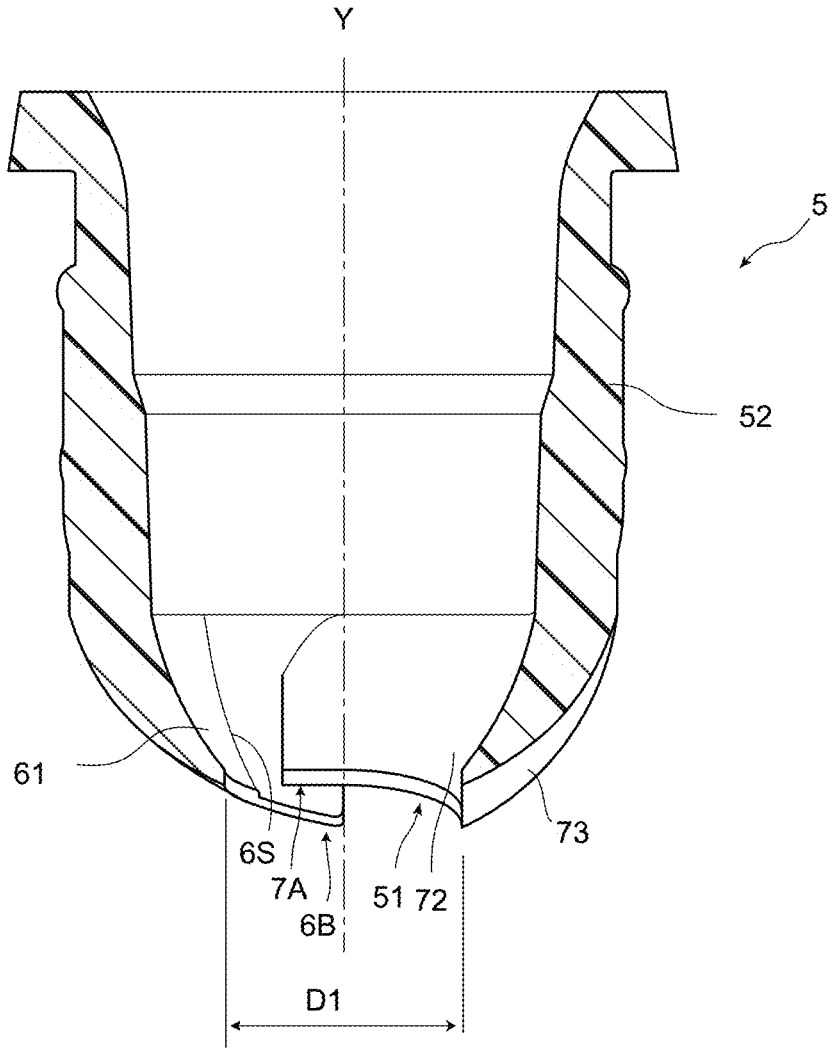
FIG. 9 is a sectional view taken along line IX-IX in FIG. 3.
Figure 10:
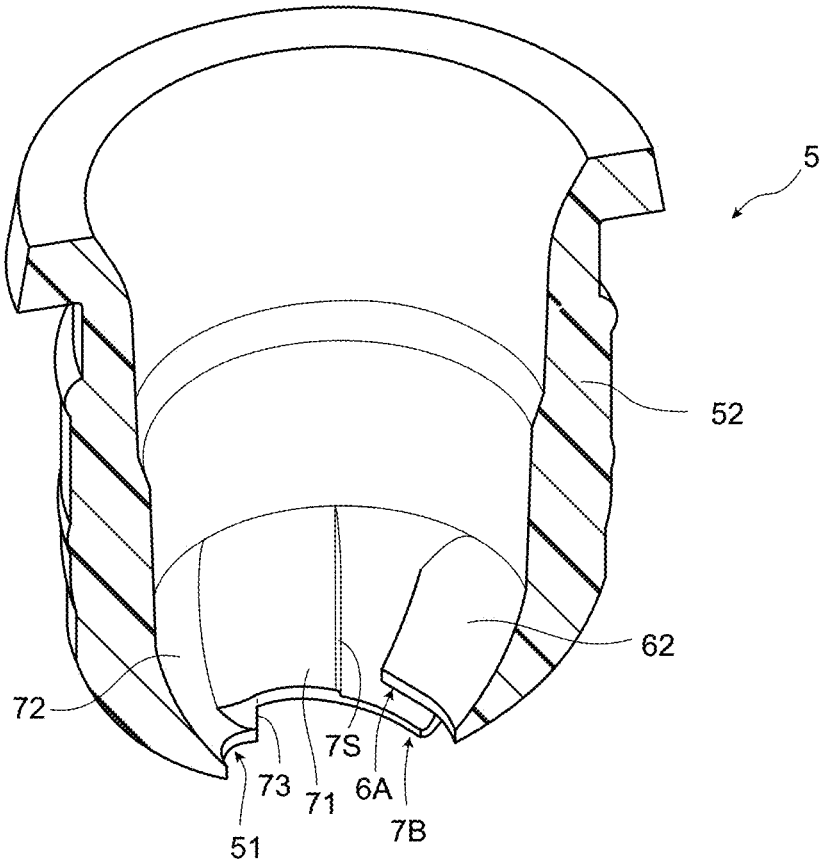
FIG. 10 is a sectional perspective view taken along line X-X in FIG. 3.

FIGS. 8 to 10 are sectional views of the wiper, and FIG. 8 is a sectional view taken along line VIII-VIII in FIG. 3, FIG. 9 is a sectional view taken along line IX-IX in FIG. 3, and FIG. 10 is a sectional perspective view taken along line X-X in FIG. 3.

Figure 11:
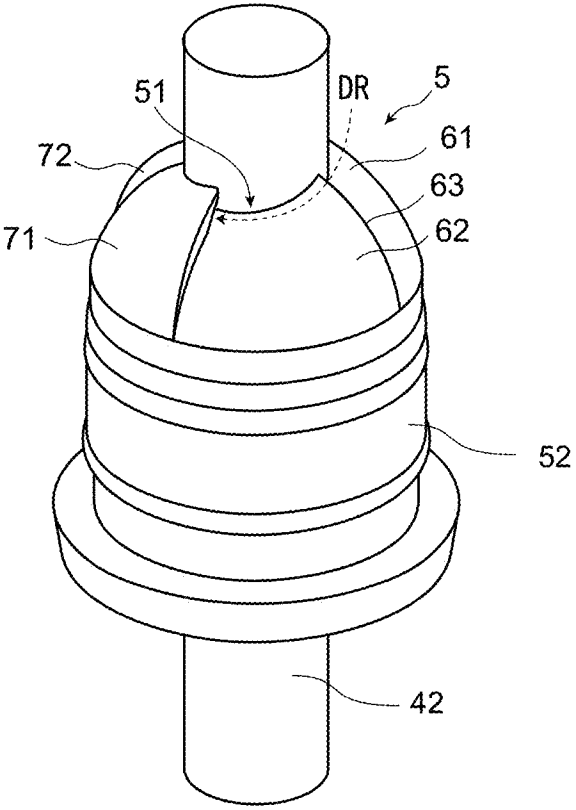
FIG. 11 are perspective views illustrating a state where a stem portion is inserted into the wiper, FIG. 11(A) corresponds to FIGS. 6 and 11(B) corresponds to FIG. 7.
Figure 11:
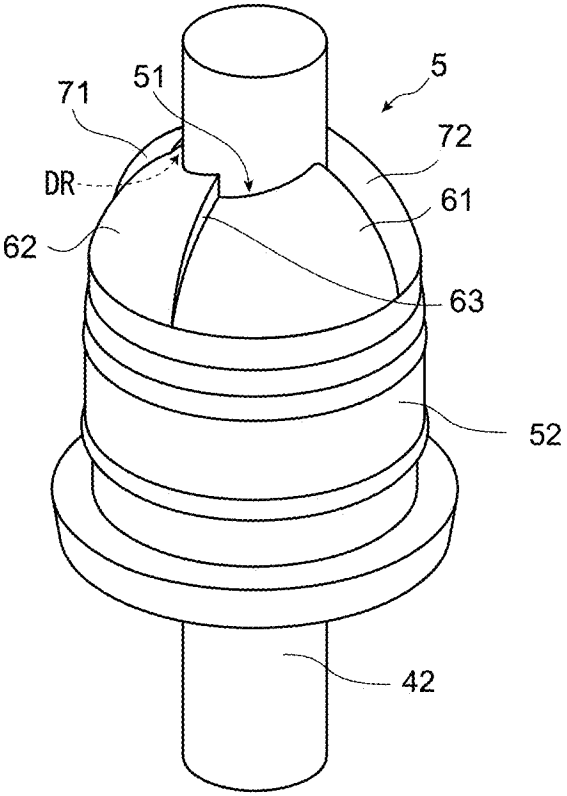

FIG. 11 illustrate a state where the stem portion 42 of the applicator 4 is inserted into the wiper 5, and FIG. 11(A) corresponds to FIG. 6, and FIG. 11(B) corresponds to FIG. 7, respectively.

The wiper 5 is an injection-molded product, and as a molding material, a synthetic resin that can be easily molded, for example, polyethylene, polypropylene, ABS resin, thermosetting elastomer, silicone, etc., is selected.

The wiper 5 is composed of a cylindrical upper portion 52 to be fitted to the opening 31, and tongue pieces 6 and 7 extending downward inside the container main body 3 from the upper portion 52. The tongue pieces 6 and 7 have the same shape, and respectively extend 180 degrees or more (less than 360 degrees) in the circumferential direction, and both of them are disposed rotationally by 180 degrees so that their regions partially overlap at both side edge portions in the circumferential direction, so that the wiper 5 has a shape point-symmetric through 180 degrees. The tongue pieces 6 and 7 are joined integrally at side edge portions in the circumferential direction.

In the present embodiment, the tongue pieces are two in number, however, the number of tongue pieces may be three or more. In this case, the tongue pieces are disposed evenly in the circumferential direction so that regions of the tongue pieces adjacent to each other partially overlap each other at both end portions.

The tongue piece 6 is composed of, from a boundary portion 63 formed at substantially the center in the circumferential direction, a first region 61 on the left side and a second region 62 on the right side in a front view, and similarly, the tongue piece 7 is composed of, from a boundary portion 73 formed at substantially the center in the circumferential direction, a third region 71 on the left side and a fourth region 72 on the right side. In FIGS. 2 to 11, the four tongue pieces appear to extend downward, however, in actuality, the boundary portions 63 and 73 are level differences formed on the outer circumferential surface, so that the first region 61 and the second region 62 are continuous with each other and the third region 71 and the fourth region 72 are continuous with each other in the circumferential direction although they have level differences formed in a thickness direction on the outer circumferential surface, so that the overlapping portions where the tongue pieces 6 and 7 overlap are only two portions of the overlap regions E1 and E2 indicated by grid patterns in FIG. 3.

As illustrated in FIG. 2, in the first region 61 as a left region of the tongue piece 6 in a front view, an extending amount in the axial direction, that is, a length in the axial direction is longest at the left side edge portion 6B, and shortest at the boundary portion 63 as a boundary with the adjacent second region 62, and gradually decreases in the axial direction from the right side edge portion 6A toward the boundary portion 63. Accordingly, a free end portion 51 of the first region extends spirally.

In the second region 62 that is the right region of the tongue piece 6 in a front view, a length in the axial direction becomes longest at the boundary portion 63, gradually decreases toward the right side edge portion 6A, and becomes shortest at the right side edge portion 6A. Accordingly, a free end portion 51 of the second region 62 is formed spirally as in the first region.

The tongue piece 7 is also formed similarly, and is divided into left and right regions of a third region 71 and a fourth region 72 by a boundary portion 73 extending vertically at substantially the center of the tongue piece 7, and the third region 71 positioned on the left side in a front view decreases in length in the axial direction from the left side edge portion 7B toward the boundary portion 73, and the fourth region 72 positioned on the right side decreases in length in the axial direction from the boundary portion 73 toward the right side edge portion 7A.

In other words, due to extending amount gaps in the axial direction occurring at the boundaries between the first region 61 and the second region 62 and between the third region 71 and the fourth region 72, level differences at the boundary portions 63 and 73 are formed.

The boundary portions 63 and 73 are formed in the axial direction on the outer circumferential surface of the wiper 5, and inside portions of the boundary portions 63 and 73 are formed to fill the extending amount gaps in the axial direction and be smoothly continuous while causing slight level differences.

That is, in each of the first to fourth regions 61, 62, 71, and 72, the length in the axial direction becomes shorter from the left side end portion side toward the right side end portion side, and lengths of the left side end portions having the longest lengths in the axial direction in the respective regions are substantially equal to each other, and lengths of the right side end portions having the shortest lengths in the axial direction in the respective regions are substantially equal to each other, so that the regions have substantially the same shape. The first to fourth regions 61, 62, 71, and 72 extend evenly in the circumferential direction, so that the wiper 5 has an external shape like a shape including four tongue pieces that have similar shapes cut diagonally at lower sides and are disposed evenly.

With this configuration, the wiper 5 has a good overall mass balance, and when it is fitted to the opening 31 or when the applicator 4 is pulled out or inserted, uneven loading does not occur, and smooth pulling-out and insertion are performed and scraping unevenness is unlikely to occur.

As illustrated in FIG. 3, in a plan view of the wiper 5, a hole diameter D1 formed at the free end portion 51 at the lower side is configured to be slightly smaller than an outer diameter D2 (refer to FIG. 1) of the stem portion 42. Therefore, as illustrated in FIGS. 11(A) and 11(B), in a state where the applicator 4 is inserted into the container main body 3, the free end portion 51 is pushed by the stem portion 42 and elastically deforms, and the free end portion 51 comes into close contact with an outer circumferential surface of the stem portion 42. Accordingly, when the applicator 4 is pulled out from the container main body 3, the free end portion 51 comes into close contact with the outer surface of the stem portion 42 and performs cleaning by scraping off the cosmetic 2 adhering to the stem portion 42, and scrapes the cosmetic 2 adhering to the applying portion 43 to an appropriate amount.

The free end portion 51 at the lower side of the wiper 5 is divided into four by the first to fourth regions 61, 62, 71, and 72, however, it exists 360 degrees in the circumferential direction in a plan view, so that scraping unevenness does not occur when the applicator 4 is pulled out or inserted.

As illustrated in FIGS. 6 and 8, the right side edge portion 6A of the tongue piece 6 is configured so that its extending length in the axial direction is shorter by a predetermined distance h than the left side edge portion 6B of the tongue piece 6. The tongue piece 7 has the same shape as the tongue piece 6, and accordingly, the tongue piece 7 also has the right side edge portion 7A shorter by a predetermined distance h in the axial direction than the left side edge portion 7B.

As illustrated in FIG. 8, in a portion (overlap region E1) where the right side edge portion 6A of the tongue piece 6 and the left side edge portion 7B of the tongue piece 7 overlap each other, a tip end scraping portion of the right side edge portion 6A of the tongue piece 6 is offset upward by a predetermined distance h in the axial direction while keeping a fixed distance (D1/2) from the central axis Y, and disposed inside of the left side edge portion 7B of the tongue piece 7 with a long extending amount in the axial direction and overlaps this left side edge portion 7B. In this overlap region E1, a groove 8 sandwiched between the right side edge portion 6A of the tongue piece 6 and the left side edge portion 7B of the tongue piece 7 and extending in the circumferential direction is formed. This groove allows for communication between the inside and the outside of the wiper 5.

FIG. 11 illustrate a state where the stem portion 42 is inserted, and the arrow DR in the figure represents an air flow, and even in a state where the stem portion 42 is inserted into the container main body 3 and the free end portion 51 comes into close contact with the outer circumferential surface of the stem portion 42, air outside the wiper 5 can move to the inside of the wiper 5 via the grooves 8. Even in the state where the stem portion 42 of the applicator 4 is inserted into the wiper 5, the grooves 8 allow for communication between the inside and outside spaces of the wiper 5 (also refer to FIGS. 6 and 7 corresponding to FIG. 11).

Similarly, a groove 8 is formed in an overlap region E2 as well in which the right side edge portion 7A and the left side edge portion 6B overlap, so that grooves 8 through which air passes are formed at two locations in the circumferential direction.

Operation and Effect

When the applicator 4 is inserted into the container main body 3, the stem portion 42 (and the applicator 43) is pushed in in a state where the free end portion 51 as a scraping portion of the wiper 5 is in close contact with the outer circumferential surface of the stem portion 42, however, air inside the container main body 3 is released via the grooves 8, so that a pumping phenomenon in which the pressure inside the container main body 3 rises to be high does not occur.

When the applicator 4 is pulled out from the container main body 3, the applicator 4 is pulled out in a state where the free end portion 51 of the wiper 5 is in close contact with the outer circumferential surface of the stem portion 42, and cosmetic 2 adhering to the stem portion 42 is scraped off. Even during this time, the inside and the outside of the wiper 5, and eventually, the inside and the outside of the container main body 3, communicate with each other via the grooves 8, so that the outside air can enter the inside of the container main body 3 through the grooves 8, so that the pressure inside the container main body 3 becomes negative and resistance does not act against pulling-out of the applicator 4, and the applicator 4 can be smoothly pulled out.

The wiper 5 has a point-symmetric shape, the tongue pieces 6 and 7 exist evenly in the circumferential direction, and the grooves 8 are formed at two locations opposed to each other. Accordingly, air easily enters and exits, so that the applicator 4 can be smoothly attached to and detached from the container main body 3.

In addition, the tongue pieces 6 and 7 having the same shape are disposed evenly in the circumferential direction, so that the wiper 5 has a good overall mass balance, and is press-fitted in the opening 31 of the container main body 3 without a tilt, and even when the applicator 4 is pulled out or inserted, no tilt occurs, and the applicator can be smoothly pulled out and inserted, so that unevenness does not occur in scraping of the cosmetic 2. Further, the first to fourth regions 61, 62, 71, and 72 having substantially the same shape exist evenly in the circumferential direction, so that the overall balance is further improved, and uneven loading and scraping unevenness due to uneven loading are prevented.

In the present embodiment, the right side edge portion 6A of the tongue piece 6 and the right side edge portion 7A of the tongue piece 7, disposed at inner sides at the overlapping portions of the tongue pieces 6 and 7, are cut out in the overlapping portions (refer to cutout portions CUT in FIG. 3). The circumferential end portion of the right side edge portion 6A is cut out vertically, and accordingly, the groove 8 can easily guide air to the inside or outside of the container main body 3.

The free end portion 51 except for the cutout portions CUT, which is colored portions in FIGS. 6 and 7, serves as a scraping portion that comes into contact with the applicator 4. The free end portion 51 is divided into the first to fourth regions 61, 62, 71, and 72, and is not continuous in the axial direction, however, the free end portion 51 is exists seamlessly in the circumferential direction, so that the entire outer circumferential surface of the stem portion 42 is evenly scraped, and there is less possibility that the cosmetic 2 adhering to the stem portion 42 is left without being scraped.

Inside the tongue pieces 6 and 7, level difference portions 6S and 7S are formed so that the thicknesses on the sides of the left side edge portion 6B of the tongue piece 6 and the left side edge portion 7B of the tongue piece 7 disposed at the outer sides in the overlapping portions become thin (refer to FIGS. 6, 8, and 10. In the fourth region 72 of the tongue piece 7, the left side edge portion 7B side becomes thin due to the level difference portion 7S). Due to the level difference portions 6S and 7S, the regions of the grooves 8 can be widened, and according to this, air easily passes through, and the applicator 4 can be smoothly pulled out and inserted. As a matter of course, the level difference portions 6S and 7S only make it easier for air to be released, and even in a form in which the level difference portions 6S and 7S are not formed, the grooves 8 allow for communication between the inside and the outside of the wiper 5, so that the form in which the level difference portions 6S and 7S are not formed is also allowed.

In the first to fourth regions 61, 62, 71, and 72, the scraping portion at the lower side is formed to be spiral, and a rotation direction of this spiral is the same as that of the screw of the opening 31. When the applicator 4 is pulled out from the container main body 3, in order to unscrew it, the applicator 4 is pulled out while being rotated in reverse, so that the free end portion 51 becomes substantially orthogonal to the stem portion 42 and comes into contact with the stem portion 42, and this improves the scraping effect.

Further, the boundary portions 63 and 73 are formed to be thick to fill the gaps in the axial direction, and have high rigidity. Thick portions extending in the axial direction are formed at substantially the center of the tongue pieces 6 and 7, so that the rigidities of the entire tongue pieces 6 and 7 are increased, and the tongue pieces 6 and 7 can be prevented from being deteriorated in rigidity and degraded in scraping performance according to repetition of pulling-out and insertion of the applicator 4.

Preferred embodiments and modifications of the present invention have been described above, and these described above are just examples of the present invention, and can be combined based on knowledge of a person skilled in the art, and such a combined embodiment is also included in the scope of the present invention.

REFERENCE SIGNS LIST

1: Cosmetic container
2: Cosmetic

3: Container main body
4: Applicator
5: Wiper
6, 7: Tongue piece
6A: Right side edge portion
6B: Left side edge portion
6S, 7S: Level difference portion
7A: Right side edge portion
7B: Left side edge portion
8: Groove
31: Opening
42: Stem portion
51: Free end portion
61: First region
62: Second region
63, 73: Boundary portion
71: Third region
72: Fourth region
E1, E2: Overlap region
CUT: Cutout portion
h: Predetermined distance

The invention claimed is:

1. A cosmetic container comprising: a container main body configured to hold a cosmetic; and an applicator to be detachably attached to an opening of the container main body, where a flexible wiper configured to scrape the cosmetic adhering to the applicator is press-fitted to the inside of the opening of the container main body, wherein the wiper includes a cylindrical portion to be fitted to the inside of the opening, and a plurality of tongue pieces having the same shape disposed evenly in a circumferential direction and extending downward inside the container main body from the cylindrical portion, the plurality of tongue pieces are disposed evenly so that regions of the tongue pieces adjacent to each other partially overlap in the circumferential direction and are joined and integrated in the overlapping portion, each of the tongue pieces is formed so that an extending length of a first circumferential side edge portion on one side in an axial direction becomes longer by a predetermined length than an extending length of a second circumferential side edge portion on the other side in the axial direction, in each of the portions where the tongue pieces adjacent to each other overlap, the tongue pieces are disposed so that the tongue piece side with the short extending length in the axial direction is inside, and inside the overlap region, a groove sandwiched between the tongue pieces, extending in the circumferential direction, and allowing for communication between outside and inside spaces of the wiper, is formed, and in a portion where the second circumferential side edge portion of the tongue piece overlaps the adjacent tongue piece, a cutout cutting at least a part of an inner surface for scraping the applicator at a lower end portion of the tongue piece is formed.

2. The cosmetic container according to claim 1, wherein a boundary portion as a level difference extending in an axial direction is formed at substantially the center of the tongue piece, and the boundary portion divides the tongue piece into two regions of a first region including the first circumferential side edge portion having a long extending length in the axial direction and a second region including the second circumferential side edge portion having a short extending length in the axial direction, in the first region, from the first circumferential side edge portion at which the extending length in the axial direction is longest toward the boundary portion, the extending length in the axial direction gradually decreases, in the second region, the extending length in the axial direction is longest at the boundary portion, and the extending length in the axial direction gradually decreases from the boundary portion toward the second circumferential side edge portion, and the inside of the boundary portion of the tongue piece is formed to fill an extending amount gap in the axial direction and be smoothly continuous, and inside the boundary portion, a curved surface extending in a direction away from the center in the circumferential direction is provided from a circumferential end portion of the level difference portion.

3. The cosmetic container according to claim 2, wherein the cutout is formed so that at least a part of a lower end portion for scraping the applicator in the second circumferential edge portion of the overlapping portion is separated from the applicator by the cutout.

4. The cosmetic container according to claim 3, wherein in a portion where the second circumferential side edge portion of the tongue piece overlaps the adjacent tongue piece, at least at part of the tongue piece, the cutout is formed so as to cut the whole thickness of the tongue piece.

5. The cosmetic container according to claim 2, wherein in a portion where the second circumferential side edge portion of the tongue piece overlaps the adjacent tongue piece, at least at part of the tongue piece, the cutout is formed so as to cut the whole thickness of the tongue piece.

6. The cosmetic container according to claim 1, wherein a level difference portion is formed inside of the tongue piece so that the first circumferential side edge portion side becomes thin.

7. The cosmetic container according to claim 1, wherein the tongue piece has a shape smoothly extending downward inside the container main body from the cylindrical portion and curved inward of the cylindrical portion, and decreases in thickness downward.

8. The cosmetic container according to claim 1, wherein the cutout is formed so that at least a part of a lower end portion for scraping the applicator in the second circumferential edge portion of the overlapping portion is separated from the applicator by the cutout.

9. The cosmetic container according to claim 1, wherein in a portion where the second circumferential side edge portion of the tongue piece overlaps the adjacent tongue piece, at least at part of the tongue piece, the cutout is formed so as to cut the whole thickness of the tongue piece.

* * * * *